US009274473B2

(12) United States Patent
Mogi

(10) Patent No.: US 9,274,473 B2
(45) Date of Patent: Mar. 1, 2016

(54) IMAGE FORMING APPARATUS

(71) Applicant: CANON KABUSHIKI KAISHA, Tokyo (JP)

(72) Inventor: Keisuke Mogi, Noda (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/013,594

(22) Filed: Aug. 29, 2013

(65) Prior Publication Data

US 2014/0064788 A1 Mar. 6, 2014

(30) Foreign Application Priority Data

Sep. 6, 2012 (JP) ..... 2012-195667

(51) Int. Cl.
*G03G 15/16* (2006.01)
*G03G 15/20* (2006.01)

(52) U.S. Cl.
CPC ..... *G03G 15/2064* (2013.01); *G03G 15/2053* (2013.01); *G03G 2215/2035* (2013.01)

(58) Field of Classification Search
USPC ..... 399/122
See application file for complete search history.

(56) References Cited

U.S. PATENT DOCUMENTS 5,323,216 A * 6/1994 Mahoney ..... 399/45
6,054,677 A * 4/2000 Morigami et al. ..... 219/216
6,366,746 B1 * 4/2002 Sasago et al. ..... 399/90
8,554,097 B2 10/2013 Hara et al.
2005/0271432 A1 12/2005 Chiba
2007/0053712 A1 * 3/2007 Fujiwara et al. ..... 399/88
2010/0329729 A1 * 12/2010 Koshida ..... 399/110
2011/0229229 A1 * 9/2011 Kajita ..... 399/330
2012/0063822 A1 * 3/2012 Funabiki et al. ..... 399/323
2013/0101310 A1 * 4/2013 Kawabata et al. ..... 399/92
2014/0037308 A1 * 2/2014 Nawa; Masahiro ..... G03G 15/2017 399/45
2014/0064755 A1 * 3/2014 Mogi ..... G03G 15/2032 399/43
2014/0064787 A1 * 3/2014 Mogi; Keisuke .. G03G 15/2053 399/122

FOREIGN PATENT DOCUMENTS

JP 3-148681 A 6/1991
JP 2005-351939 A 12/2005

* cited by examiner

*Primary Examiner* — Rochelle-Ann J Blackman
*Assistant Examiner* — Linda B Smith
(74) *Attorney, Agent, or Firm* — Fitzpatrick, Cella, Harper & Scinto

(57) ABSTRACT

A fixing device includes a fixing device including rollers which form a nip therebetween to fix a toner image on a sheet; a supporting mechanism for movably supporting the fixing unit; a reciprocating mechanism for reciprocating the fixing unit relative to the supporting mechanism in a longitudinal direction thereof; an electric connector provided on the supporting mechanism; and a wire connecting between the electric energy supply connector and the fixing unit and having an enough length to permit reciprocation of the fixing unit.

8 Claims, 10 Drawing Sheets

IMAGE FORMING APPARATUS

FIELD OF THE INVENTION AND RELATED ART

The present invention relates to an image heating apparatus such as a fixing device for fixing a toner image on a sheet, and an image forming apparatus provided with the image heating apparatus, such as a copying machine, a printer, a facsimile machine or a complex machine having plural functions of such machines.

In the image forming apparatus for forming an image through an electrophotographic type process, an image forming station forms a toner image, transfers the toner image onto a recording material (sheet) and fixes the toner image on the recording material by heating the recording material having the transferred toner image by a fixing device.

In such a fixing device, when the recording material is nipped by a nip, lateral edge portions (edges of widthwise ends) of recording material is in contact with a fixing member. At this time, the surface of the fixing member tends to be damaged by the lateral edge portion of recording material.

When such a damage by the edge of recording materials having a small width occurs, the resulting unsmoothness of the surface of the fixing member appears on a large width recording material subsequently processed.

In order to reduce the influence of the damage by the lateral edge, Japanese Laid-open Patent Application 2005-351939) proposes that an entirety fixing device (pair of rotatable members) is reciprocated in the widthwise direction of recording material.

On the other hand, in the image forming apparatus, a maintenance operation is necessary when sheet jamming, parts deterioration or damage occurs, and for permitting the maintenance operation, the fixing device is drawable to an outside of the image forming apparatus.

In such a structure, it is necessary that an electrical part in the fixing device can be supplied with electric power from the main assembly of the apparatus and can be communicated with the main assembly side. Therefore, connectors are provided in the fixing device and in the main assembly of the image forming apparatus, and the connectors are connected with each other when the fixing device is inserted into the image forming apparatus (Japanese Laid-open Patent Application Hei 3-148681).

However, in the case that the fixing unit is reciprocable, the position of the connector of the fixing device side may be a problem. For example, the reciprocation of the fixing device may apply a load to the connecting portion of the connector to make the connector connection unstable.

Even if the connector is urged by a spring, it is not avoidable that the reciprocation movement of the fixing unit influences the connection of the connectors.

SUMMARY OF THE INVENTION

According to an aspect of the present invention, there is provided a fixing device comprising a fixing device including a pair of rotatable members which form a nip therebetween to fix a toner image on a sheet; a supporting mechanism configured and positioned to movably support said fixing unit; a reciprocating mechanism configured and positioned to reciprocate said fixing unit relative to said supporting mechanism in a longitudinal direction thereof; an electric energy supply connector provided on said supporting mechanism and configured and positioned to supply electric energy to said fixing unit; and an electric energy supply wire connecting between said electric energy supply connector and said fixing unit and having an enough length to permit reciprocation of said fixing unit.

According to another aspect of the present invention, there is provided an image forming apparatus comprising (i) an image forming station configured to form a toner image on a sheet; (ii) a fixing device configured and positioned to fix the toner image formed on the sheet by said image forming station, said fixing device comprising (ii-i) a fixing device including a pair of rotatable members which form a nip therebetween to fix a toner image on a sheet, (ii-ii) a supporting mechanism configured and positioned to movably support said fixing unit, (ii-iii) a reciprocating mechanism configured and positioned to reciprocate said fixing unit relative to said supporting mechanism in a longitudinal direction thereof, (ii-iv) an electric energy supply connector provided on said supporting mechanism and configured and positioned to supply electric energy to said fixing unit, and (ii-v) an electric energy supply wire connecting between the electric energy supply connector and said fixing unit and having an enough length to permit reciprocation of said fixing unit; (iii) a drawing mechanism configured to permit drawing said fixing device out of said image forming apparatus while supporting said fixing device; (iv) an apparatus connector connectable to said electric energy supply connector by insertion of said drawing mechanism into said image forming apparatus; and (v) an urging mechanism configured and positioned to urge said apparatus connector toward said electric energy supply connector.

According to a further aspect of the present invention, there is provided a fixing device comprising a fixing device including a pair of rotatable members which form a nip therebetween to fix a toner image on a sheet; a supporting mechanism configured and positioned to movably support said fixing unit; a reciprocating mechanism configured and positioned to reciprocate said fixing unit relative to said supporting mechanism in a longitudinal direction thereof; a communication connector provided on said supporting mechanism and configured and positioned to communicate with said fixing unit; and a communication wire connecting between communication connector and said fixing unit and having an enough length to permit reciprocation of said fixing unit.

According to a further aspect of the present invention, there is provided an image forming apparatus comprising (i) an image forming station configured to form a toner image on a sheet; (ii) a fixing device configured and positioned to fix the toner image formed on the sheet by said image forming station, said fixing device comprising (ii-i) a fixing device including a pair of rotatable members which form a nip therebetween to fix a toner image on a sheet, (ii-ii) a supporting mechanism configured and positioned to movably support said fixing unit, (ii-iii) a reciprocating mechanism configured and positioned to reciprocate said fixing unit relative to said supporting mechanism in a longitudinal direction thereof, (ii-iv) a communication connector provided on said supporting mechanism and configured and positioned to communicate with said fixing unit, and (ii-v) a communication wire connecting between communication connector and said fixing unit and having an enough length to permit reciprocation of said fixing unit; (iii) a drawing mechanism configured to permit drawing said fixing device out of said image forming apparatus while supporting said fixing device; (iv) an apparatus connector connectable to said communication connector by insertion of said drawing mechanism into said image forming apparatus; and (v) an urging mechanism configured and positioned to urge said apparatus connector toward said communication connector.

These and other objects, features, and advantages of the present invention will become more apparent upon consideration of the following DESCRIPTION OF THE EMBODIMENTS of the present invention, taken in conjunction with the accompanying drawings.

DESCRIPTION OF THE EMBODIMENTS

Referring to FIG. 1 to FIG. 10, an embodiment of the present invention will be described.

Figure 1:
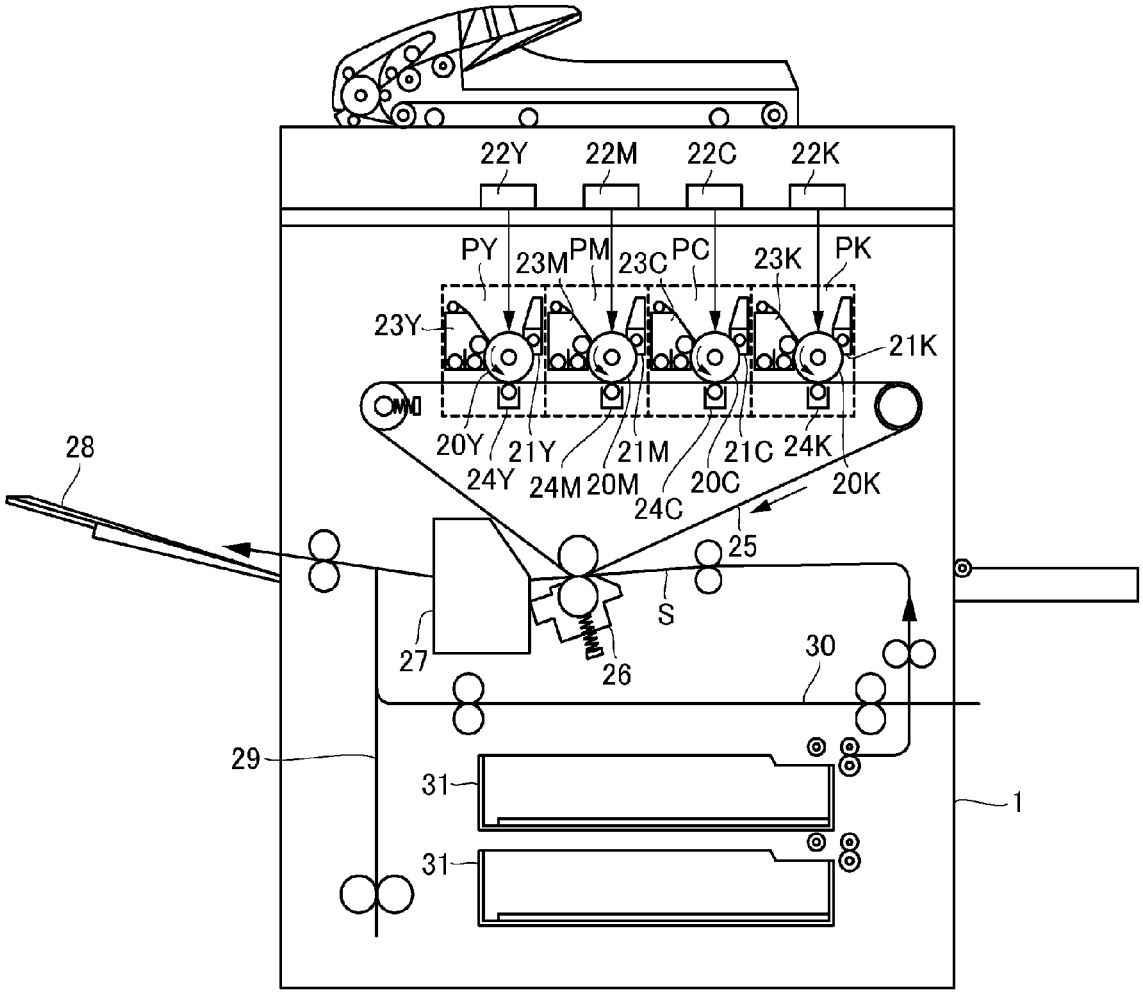
FIG. 1 is a schematic sectional view of an image forming apparatus.

Referring first to FIG. 1, an image forming apparatus according to this embodiment will be described.

[Image Forming Apparatus]

The image forming apparatus 1 comprises a fixing device 27 as an image heating apparatus which fixes an unfixed image transferred onto a recording material (sheet) S such as paper by applying heat and pressure. In this embodiment, the image forming apparatus is of a full-color and intermediary transfer type, but the present invention is applicable to another type image forming apparatus comprising an image heating device.

The image forming apparatus 1 is tandem type in which image forming stations PY, PM, PC, PK for forming Y (yellow), M (magenta), C (cyan), K (black) toner images, respectively are provided. The image forming stations PY, PM, PC, PK are arranged along a rotational moving direction of an intermediary transfer belt 25 as an intermediary transfer member and carry out the toner image the processes for the respective colors in parallel.

The image forming stations have fundamentally the same structures, and therefore, the following description of the image forming stations applies commonly to them, although suffixes Y, M, C and K are added in the drawings and only when necessary.

The image forming station P includes a photosensitive drum 20 as an image bearing member on which a toner image is formed and carried. Around the photosensitive drum 20, there are provided a charging device 21, a developing device 23, a primary transferring device 24 (unshown) and a cleaner. Above the image forming apparatus 1, an exposure device 22 is provided.

Photosensitive drum 20 is rotated in the direction indicated by the arrow in the Figure, during which a surface of the photosensitive drum 20 is uniformly charged to a predetermined potential by the charging device 21. Thereafter, the charged surface of the photosensitive drum 20 is exposed by the exposure device 22 so that an electrostatic latent image is formed on the photosensitive drum 20. The electrostatic latent image on the photosensitive drum 20 is developed with a developer by the developing device 23 into a visualized toner image.

The toner image formed by the developing device 23 is primary-transferred superposingly on an endless intermediary transfer belt 25 from the photosensitive drum 20 by a primary transferring device 24. The toner images above intermediary transfer belt 25 are secondary-transferred all together onto the recording material S by a secondary transfer device 26. The surface of the photosensitive drum 20 after the primary transfer and the surface of the intermediary transfer belt 25 after the secondary transfer are cleaned by the cleaner (unshown) to be prepared for the next image formation.

The recording material (sheet) S is fed to a secondary transfer portion comprising a secondary transfer device 26 and the intermediary transfer belt 25, by a feeding means such as a feeding roller, from a sheet feeding cassette 31. After the secondary transfer, the recording material S carrying the toner image is fed to the fixing device 27. The fixing device 27 heats and presses the unfixed toner image to melt and soften it, thus fixing it on the recording material S. The recording material S having the fixed toner image is discharged to a sheet discharge tray 28. When an image is to be formed also on the back side of the recording material S, the recording material S is reverted by a recording material reversing path 29 and is refed to the secondary transfer portion along the duplex print feeding path 30, where it receives the side on the back side.

As described in the foregoing, a series of image forming process operations including the charging, the exposure, the development, the transfer and the fixing is executed to form the image on the recording material S. If the image forming apparatus is a monochromatic image forming apparatus, only a black image forming station is provided. The structures and the order of the Y, M, C, K image forming stations are not limited to those described above.

[Fixing Device]

Figure 2:
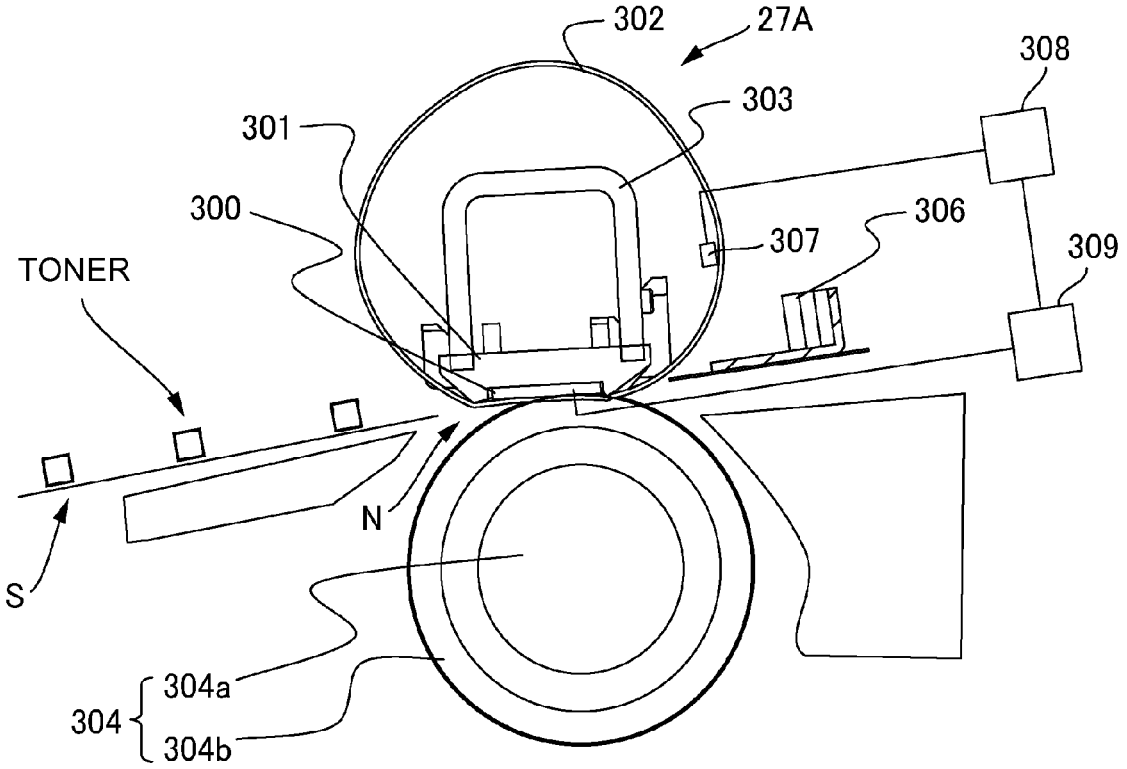
FIG. 2 is a schematic sectional view of a heating unit of a fixing device.

Referring to FIG. 2 through FIG. 5, a heating unit (fixing unit) 27A of the fixing device 27 according to this embodiment will be described. As shown in FIG. 2, the heating unit 27A comprises an endless heating belt (first rotatable member) 302 as a rotatable heating member, and a pressing roller (second rotatable member) 304 as a pressing rotatable member forming a nip N between an outer peripheral surface of the heating belt 302 and the heating belt 302. Inside the heating belt 302, there is provided a heater (ceramic heater) 300 as a heating mechanism.

The heater 300 comprises an elongated thin-plate-like ceramic substrate elongated in a perpendicular direction to the sheet of the drawing of FIG. 1 (front and back direction), and a heat generating resistor layer provided on the surface of the substrate, as basic elements. Such a heater 300 is a low thermal capacity heater which is heated steeply by the electric power supply from a voltage source 309 to the heat generating resistor layer.

The heater 300 is fixed to a heater holder 301. The heater holder 301 has a trough like shape having a substantially half-arc cross-section and is a heat insulation member of heat resistive resin material or the like elongated in the direction perpendicular to the sheet of the drawing of FIG. 1. The heater 300 is fitted into a groove portion formed in the lower surface of heater holder 301 along the length thereof and is fixed by a heat resistive adhesive, with the heater surface side facing downward. Designated by 303 is a stay provided inside of heater holder 301 to support the heater holder 301.

The heating belt 302 is made of a heat resistive film, for example, and is loosely fitted around the heater holder 301 including the heater 300. The heating belt 302 has a composite layer in order to improve a quick start property by reducing the thermal capacity as follows. The belt comprises a base layer of metal such as SUS or Ni, having a film thickness of not more than 100 μm, preferably 20-50 μm. The outer peripheral surface thereof is coated with a heat resistive rubber such as silicone rubber or fluorine-containing rubber, or an elastic layer of a foam member of silicone rubber. The outer peripheral surface thereof is further coated with PTFE, PFA or the like layer having a thickness of approx. 5-50 μm. An inner surface of the base layer is provided with a protection layer of PI (polyimide) or the like having a thickness of several μm to reduce a sliding friction between the heater 300 and the metal layer of the heating belt 302.

The pressing roller 304 comprises a core metal 304*a*, and an elastic layer 304*b* of heat resistive rubber such as silicone rubber or fluorine-containing rubber or a foam member of silicone rubber, and the opposite end portions of the core metal 304*a* are rotatably supported by side plates 400, 401. As shown in FIG. 2, above the top side of the pressing roller 304, the heater 300, the heater holder 301, the heating belt 302 and an assembly of the stay 303 are provided extended in parallel with the pressing roller 304 with the heater 300 side facing downward. The stay 303 is urged toward the pressing roller 304 by a variable pressure mechanism 500 which will be described hereinafter. By this, the lower surface (FIG. 2) of the heater 300 is press-contacted toward the outer peripheral surface of pressing roller 304 through the heating belt 302 against the elastic of the elastic layer 304*b* to form a nip N having a predetermined width.

A temperature of the heating belt 302 is monitored by a thermister 307 as a temperature detecting means outputting a detection signal to a controller (CPU) 308 of the control device. The controller 308 adjusts a current applied to the heater 300 by the voltage source 309 on the basis of the signal of the thermister 307, so that the heating belt 302 keeps a predetermined target temperature during the fixing operation.

In the state that the temperature of the heating belt 302 is controlled, the recording material carrying the toner image is fed into the nip N, and the unfixed toner image is heated and pressed so that the toner image is fixed on the recording material. The recording material after the fixing is separated from the heating belt 302, and is discharged from the nip N along a separation guide 306 provided downstream of the nip N in the feeding direction. The separation guide 306 is disposed spaced from the heating belt 302 so that the recording material discharged from the nip N is not wrapped around the heating belt 302 and so that the heating belt 302 is not damaged. Such a separation guide 306 is engaged with a part of a flange 305 which will be described hereinafter, and is fixed by an urging means such as a spring.

Figure 3:
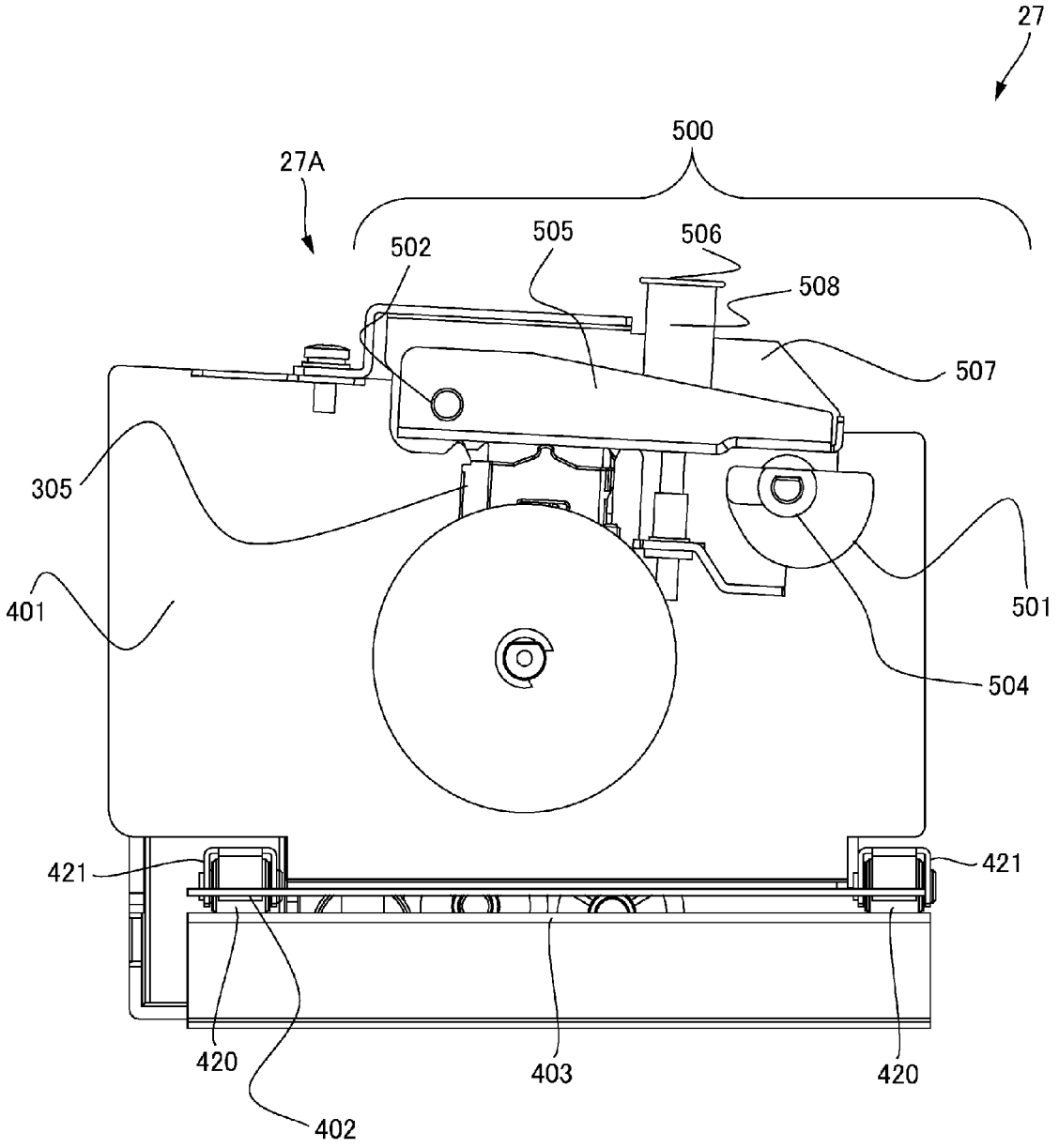
FIG. 3 is a schematic side view of the fixing device.
Figure 4:
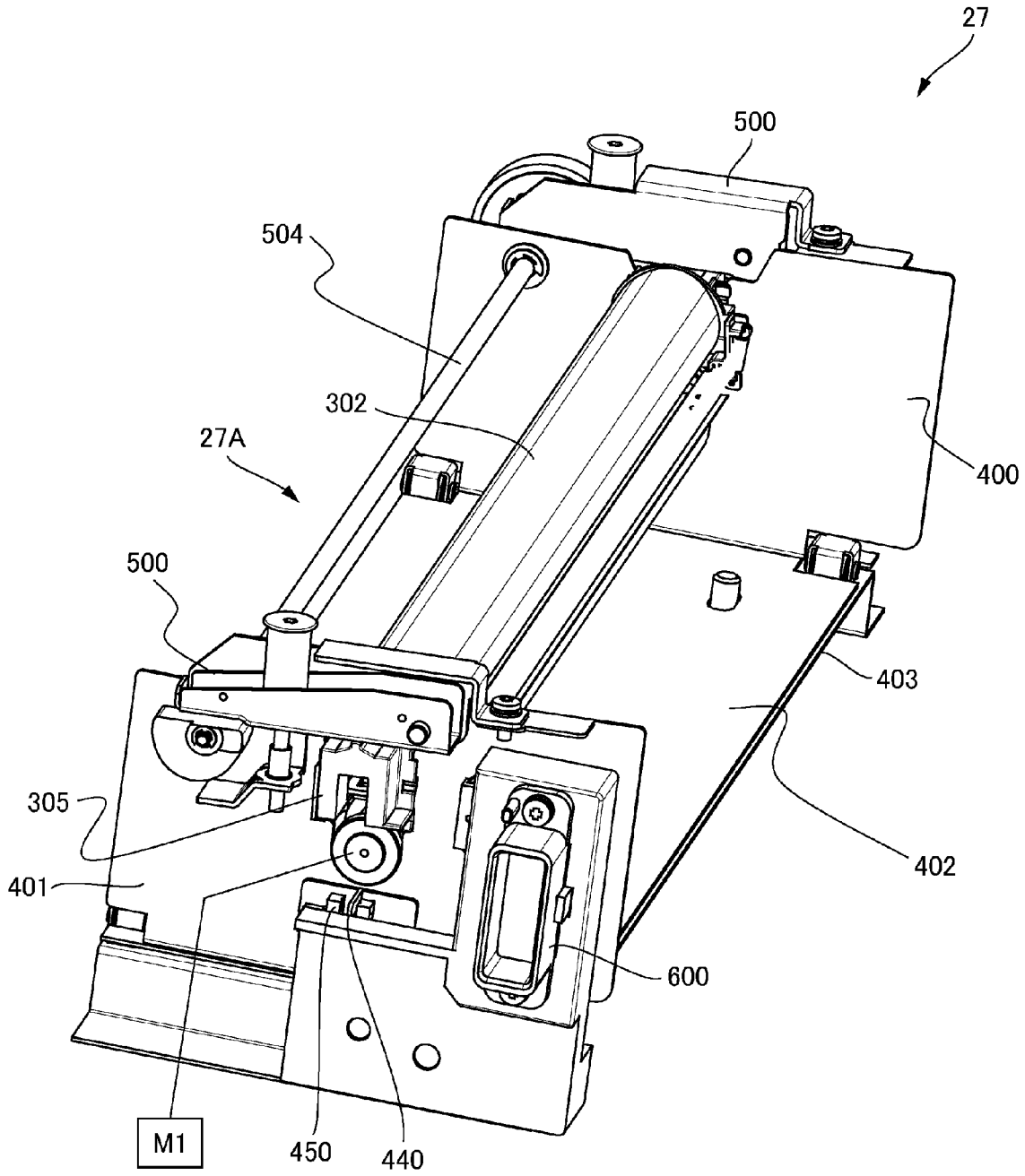
FIG. 4 is a schematic perspective view of the fixing device.

The flange 305 is supported by the side plates 400 and 401 constituting a frame (case) of the heating unit 27A as shown in FIGS. 3 and 4, and is movable toward and away from the pressing roller 304. The flange 305 is provided with a regulating member for supporting opposite end portions (rotation axial direction of the heating belt 302) of stay 303 and the heater holder 301 and for regulating a configuration in the circumferential direction and a movement in the longitudinal direction of the heating belt 302.

The heating belt 302 supported by such a flange 305 is urged toward the pressing roller 304 by the variable pressure mechanism 500 shown in FIGS. 3 and 4. The variable pressure mechanism 500 is provided at each of the opposite ends of the heating belt 302, and comprises a pressing cam 501, a pressing member rotational shaft 502, a pressing cam rotational shaft 504, a pressing member 505, a pressing adjusting screw 506, pressing supporting plate 507 and an urging spring 508.

The pressing member 505 and the pressing supporting plate 507 are supported by the side plates 400, 401 through the pressing member rotational shaft 502, and the pressing member 505 can move rotatably relative to the pressing supporting plate 507. The pressing supporting plate 507 is fixed to the side plates 400, 401. To the pressing supporting plate 507, the pressing adjusting screw 506 is fastened, and by rotating the pressing adjusting screw 506, a seat of the pressing adjusting screw 506 contracts the spring of the urging spring 508 to increase the spring load applied to the pressing member 505. The pressing member 505 is rotatably supported relative to the pressing supporting plate 507 as described above, and therefore, the compressive force of the urging spring 508 produces a moment about the pressing member rotational shaft 502.

The pressing member 505 is contacted to the flange 305. Therefore, the moment produced in the pressing member 505 pushes the flange 305 toward the pressing roller 304 to form the above-described nip N between the pressing roller 304 and the heating belt 302.

In order to release the pressure, the pressing cam 501 eccentric by a predetermined amount is rotated to push the pressing member 505 up. The pressure is released by rotating the pressing cam 501 until the pressing member 505 and the flange 305 becomes non-contacted relative to each other. The pressing cam 501 is rotated by a motor M1 as a driving source. The pressing cams 501 are provided at the opposite sides of the fixing belt 302 and are fixed to the opposite end portions of the pressing cam rotational shaft 504 with the same phase, so that they are rotated with the same phase by the motor M1. By this, the variable pressure mechanisms 500 at the opposite sides of heating belt 302 can be actuated to switch between the pressing and releasing states to the pressing roller 304. The normal pressure is 300N, for example.

When the image forming operation starts, the variable pressure mechanisms 500 press-contact the heating belt 302 to the pressing roller 304 to form the nip N. On the other hand, when the image forming operation is finished, the variable pressure mechanisms 500 releasing the heating belt 302 from the pressing roller 304, and the released state is kept.

Figure 5:
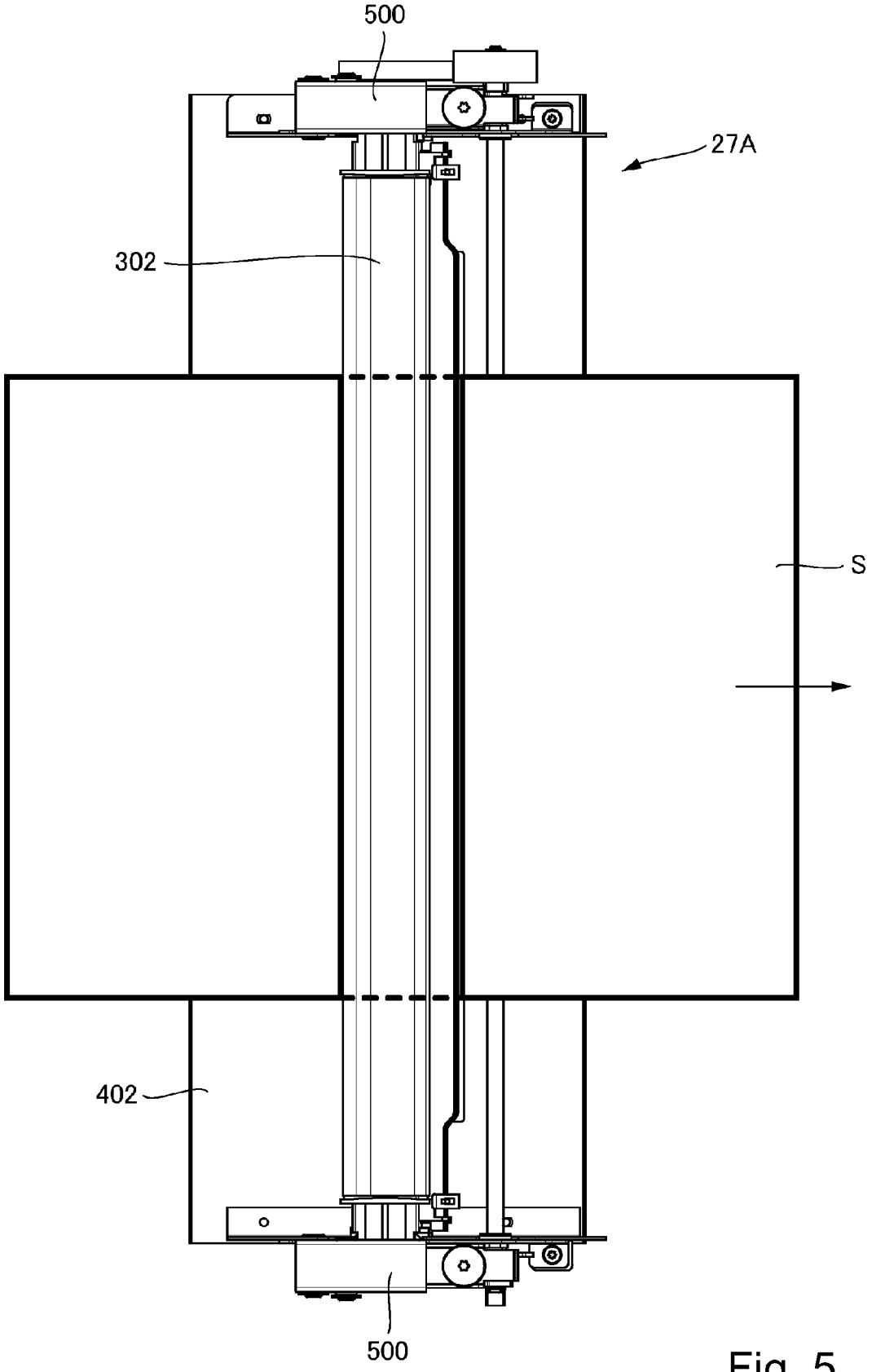
FIG. 5 is a schematic top plan view of the fixing device in which the recording material is passing the nip.

FIG. 5 shows the fixing device during the image forming operation. During the image forming operation, the nip N is formed between the heating belt 302 and the pressing roller 304 by the variable pressure mechanisms 500, and the fixing step (fixing process) is completed by passing the recording material through the nip N. The edges of the recording material have small burrs produced by cutting, and the burrs flaw surface of the heating belt 302 during the fixing step at the position corresponding to the edges of the recording material, and the flaws may appear on the prints.

When the recording materials of the same size are continuously processed, a temperature difference occurs between the recording material passing portion of the surface of the heating belt 302 and the non-passing portion of the surface of the heating belt 302. Because the heat of heating belt 302 is consumed for the toner fixing in the passing portion, but it is not consumed in the non-passing portion. By the temperature difference, a surface speed of the heating belt 302 is higher in the non-passing portion region than in the passing portion region with the result of slippage in the lateral end portions of the recording material. Therefore, the surface of the heating belt 302 results in having fine unsmoothness (fine pits and projections, damage by the lateral edges or edge flaw).

[Reciprocating Mechanism]

Figure 6:
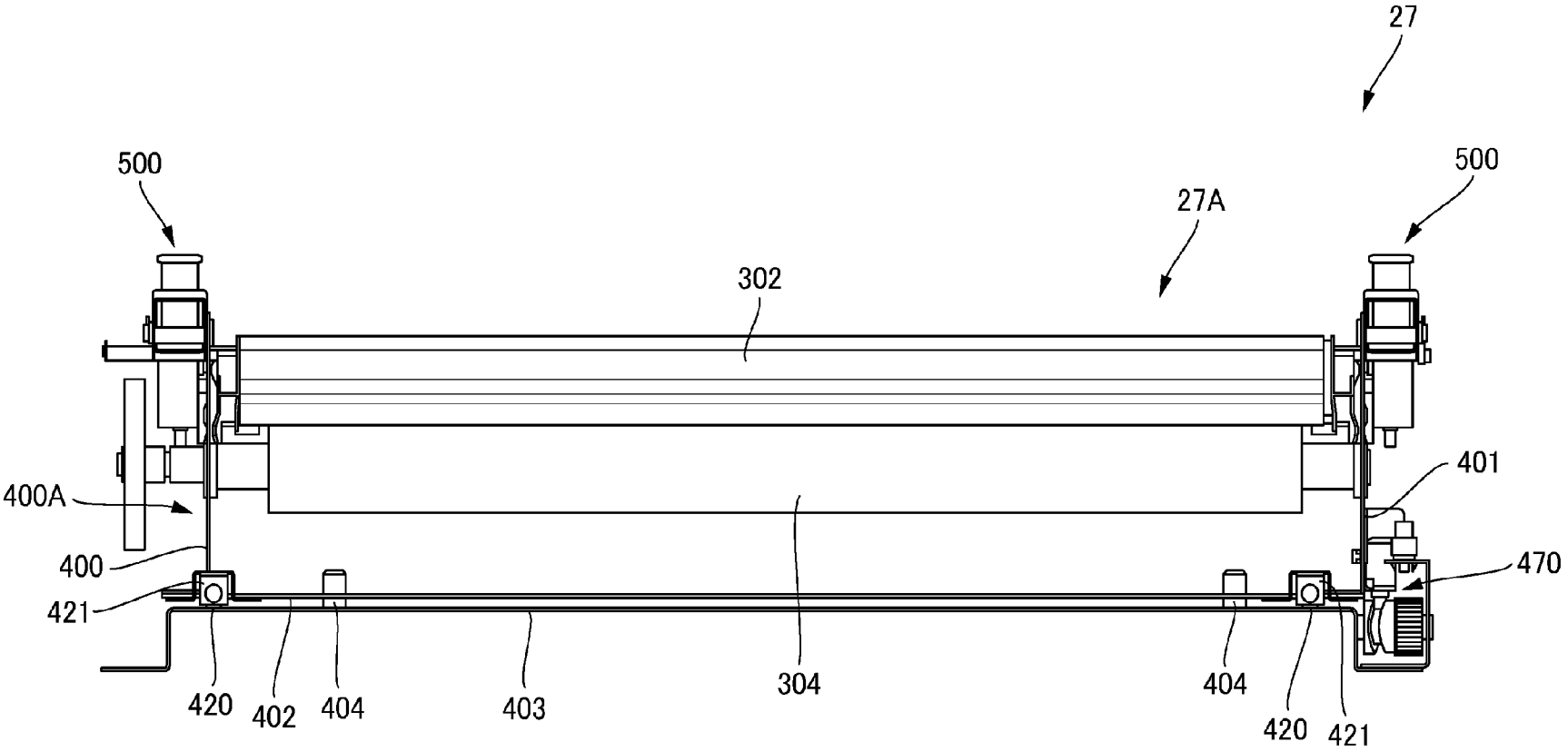
FIG. 6 is a schematic front view of the fixing device.
Figure 7:
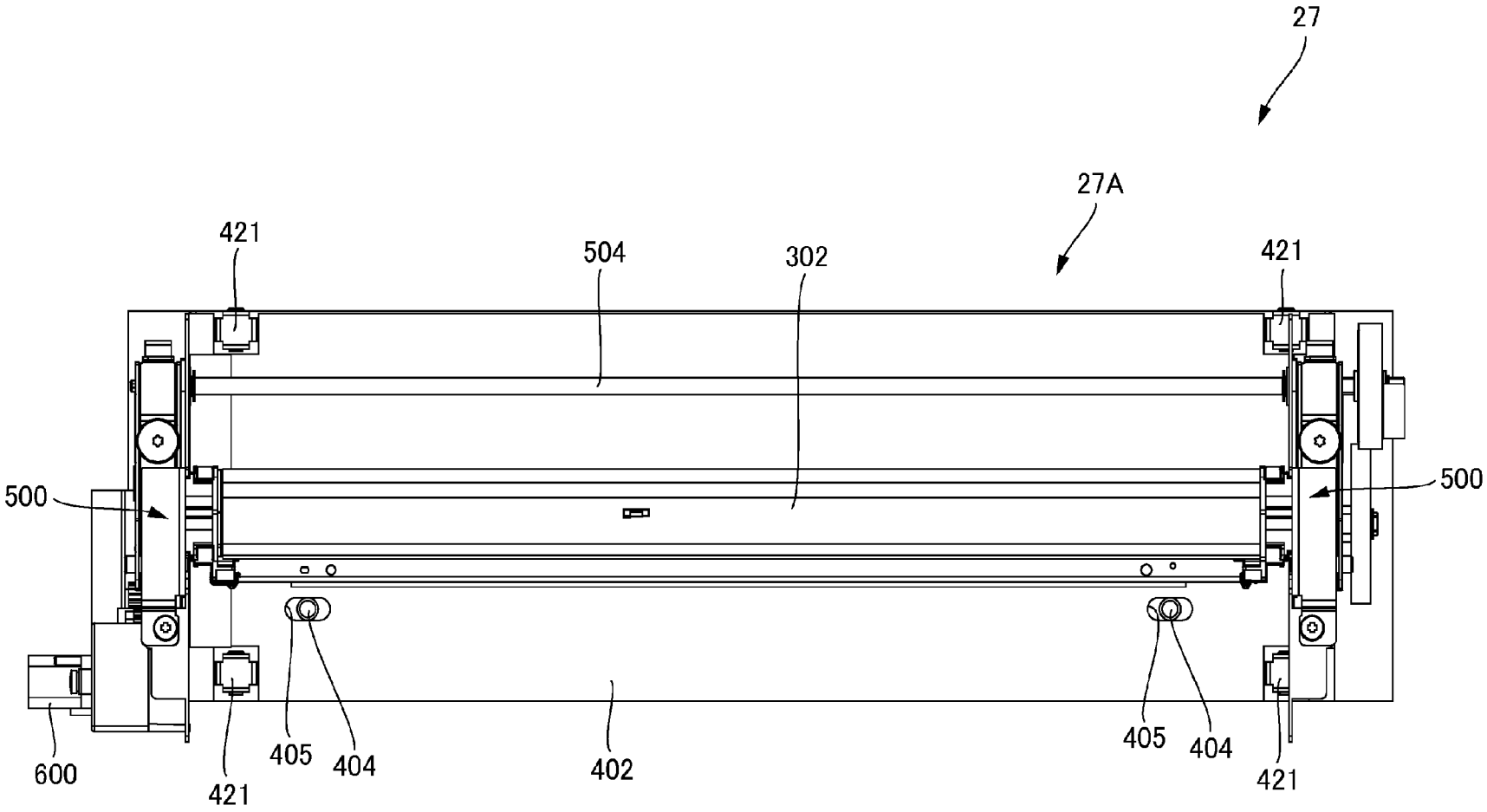
FIG. 7 is a schematic top plan view of the fixing device.
Figure 8:
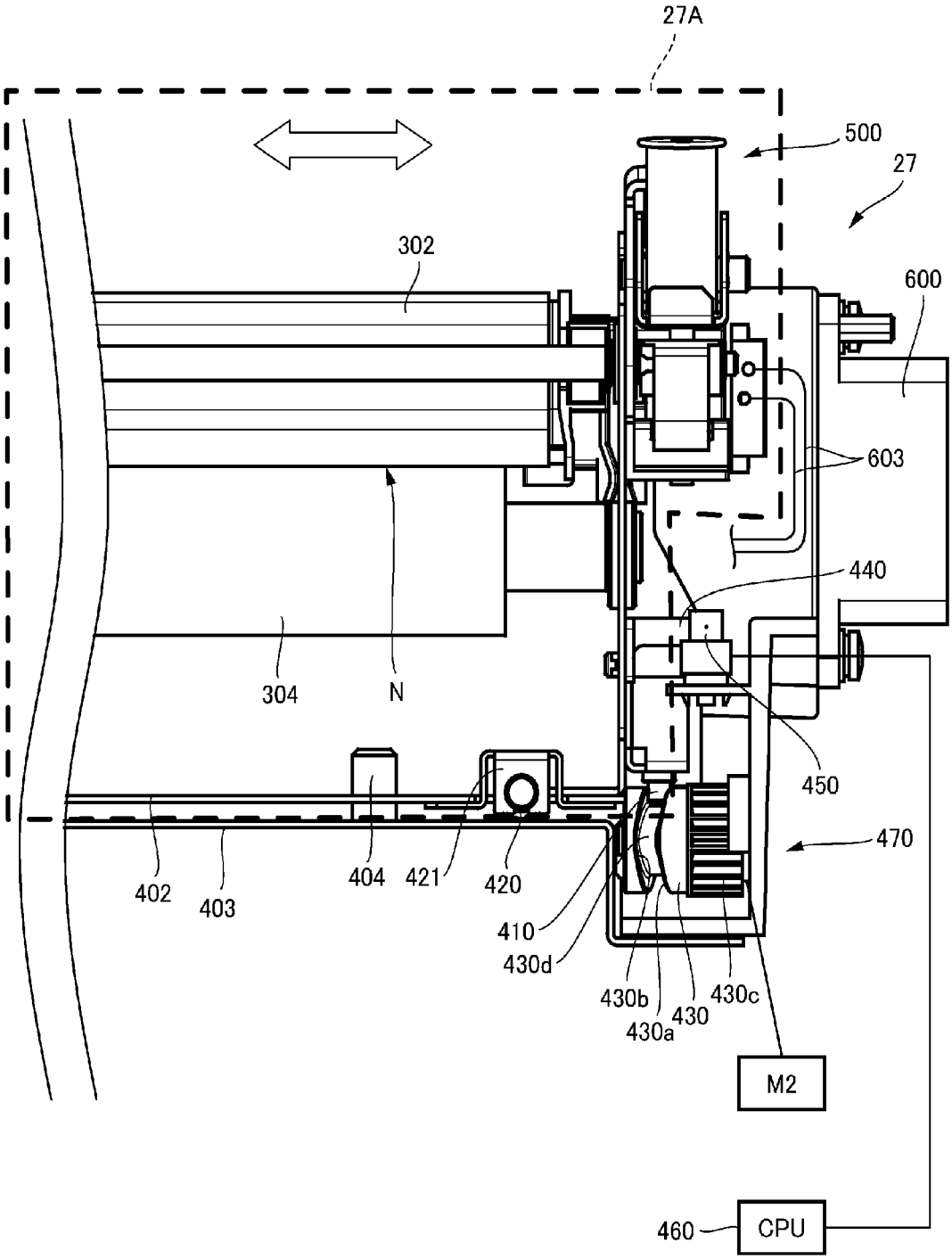
FIG. 8 is a view of a right-hand end portion of FIG. 6.

In this embodiment, in order to reduce such edge flaws, the base plate which is a supporting portion (supporting mechanism) for the heating unit 27A is reciprocated in the longitudinal direction (widthwise direction of the recording material or direction perpendicular to the feeding direction of recording material). Referring to FIG. 6 through FIG. 8, a reciprocating mechanism for reciprocation controlling will be described.

As shown in FIGS. 6 and 7, the heating unit 27A of the fixing device 27 includes a frame 400A having the front side plate 400, the rear side plate 401 and a bottom plate 402. Thus, the heating belt 302 and the pressing roller 304 including the assembly such as the heater 300 are supported by the frame 400A. In this embodiment, the front side and the rear side are based on the installed state of the image forming apparatus, and the front side is the side where the user operates the image forming apparatus, and the rear side is the opposite side.

At each of four corners of the bottom plate of the frame 400A, a roller 420 is rotatably provided using a bearing 421, and the surface of the roller 420 is slightly projected downwardly beyond the bottom plate 402. In addition, the bottom plate 402 is provided with two elongated holes 405 extending in the widthwise direction (longitudinal direction, left-right direction of FIG. 6 through FIG. 8) as an engaged portion, the elongated hole 405 being spaced from each other and being provided at a sheet discharging side.

The frame 400A of such a heating unit 27A is a part of the fixing device 27, and is supported by the reciprocation base plate 403 movably in the widthwise direction relative to the main assembly of the image forming apparatus. More particularly, by the rollers 420 provided in the bottom plate 402 rolls on the base plate 403, the frame 400A and the heating unit 27A can move in the widthwise direction relative to the base plate 403. In this manner, the bottom plate 402 is supported by the rollers 420 on the base plate 403, and therefore, the rollers 420 rotate at the time of reciprocation in which the sliding resistance is minimized.

The reciprocation base plate 403 is provided with two shafts 404 as an engaging portion in the sheet discharging side so as to engage with the elongated holes 405 of the bottom plate 402, respectively. Therefore, the frame 400A is guided in the widthwise direction by the engagement between the shaft 404 and the elongated hole 405. A movement distance in the widthwise direction is regulated by a length of the elongated hole 405 measured in the widthwise direction.

Such a reciprocating operation is carried out by a reciprocating mechanism 470 as a moving means. Referring to FIG. 8, the reciprocating mechanism 470 will be described. The reciprocating mechanism 470 is disposed at the side plate 401 side in the rear side of the fixing device 27. More specifically, the reciprocating mechanism 470 includes a reciprocating cam 430 as an inclination member (rotation cam), a reciprocating shaft 410 as an engageable member (cam follower), and a motor M2 as driving means (operating device).

The reciprocating cam 430 is provided on one of the heating unit 27A and the supporting portion, more particularly on the base plate 403 which is a supporting portion in this embodiment, and is provided with a pair of inclined surfaces 430*a*, 430*b* inclined relative to the widthwise direction. The cam 430 has a substantially cylindrical shape and is integral with the gear 430*c* to which a rotational force is applied from the motor M2, and it is provided with V-like grooves 430*d* as seen from a diametrically outside over the entire cylindrical outer peripheral surface. Opposite side surfaces of the groove 430*d* constitute the inclined surfaces 430*a*, 430*b*, respectively. The inclined surfaces 430*a*, 430*b* extend in parallel with each other, and are waved at regular intervals when they are expanded.

Reciprocating shaft 410 is provided on the other of the heating unit 27A and the supporting portion, more particularly on the side plate 401 of the heating unit 27A in this embodiment, and is engaged with the inclined surfaces 430*a*, 430*b* of the reciprocating cam 430. That is, the reciprocating shaft 410 is inserted into the groove 430*d* of reciprocating cam 430, and the outer peripheral surface of the shaft 410 is contacted to at least one of the inclined surfaces 430*a*, 430*d*.

The motor M2 causes a relative movement between the reciprocating cam 430 and the reciprocating shaft 410 to reciprocate the heating unit 27A through the engagement between the shaft 410 and the inclined surfaces 430*a*, 430*b*. In this embodiment, the motor M2 is a pulse motor, and is driven in accordance with a pulse number fed from the controller (CPU) 460 of the control device so as to rotate the reciprocating cam 430 through an amount (angle) corresponding to the pulse number. The controller 460 may be common with the above-described controller 308 for controlling the electric power supply to the heater 300.

By the relative rotation of the reciprocating cam 430 relative to the reciprocating shaft 410, the engaging position between the reciprocating shaft 410 and the inclined surfaces 430*a*, 430*b* changes. Since the inclined surfaces 430*a*, 430*b* are inclined relative to the widthwise direction as described above, the changing of the engaging position moves the shaft 410, and therefore the heating unit 27A fixed to the shaft 410, in the widthwise direction. Here, the heating unit 27A is movable only in the direction along the elongated hole 405 of the bottom plate 402 as described hereinbefore, and therefore, the heating unit 27A defined by broken lines in FIG. 8 moves only in the widthwise direction.

In addition, the pair of inclined surfaces 430*a*, 430*b* is in the form of a wave continuously extending in the circumferential direction as described above, and therefore, the rotation of the reciprocating cam 430 reciprocates the reciprocating shaft 410 in the widthwise direction along the wave shape. With such a structure of this embodiment, the reciprocation moving operation of the heating unit 27A is carried out.

The reciprocating cam 430 as the inclination member may be provided on the heating unit 27A side, and the shaft 410 as the engageable member may be provided on the base plate 403 side (supporting portion).

In addition, in this embodiment, there is provided a position sensor 450 as a position detecting means for detecting a position of the heating unit 27A with respect to the widthwise direction. The position sensor 450 is fixed on the base plate 403 and includes a light emitting portion and a light receiving portion for receiving the light emitted by the light emitting portion, the light emitting portion and the light receiving portion being disposed opposed to each other. In addition, a sensor flag 440 is provided on the rear side plate 401 of heating unit 27A. The sensor flag 440 enters between the light emitting portion and the light receiving portion of the position sensor 450 to block the light from the light emitting portion, by which the position sensor 450 detects a predetermined position of heating unit 27A with respect to the widthwise direction. The detection signal is fed to the controller 460, and the controller 460 controls the motor M2 on the basis of the signal.

Figure 9:
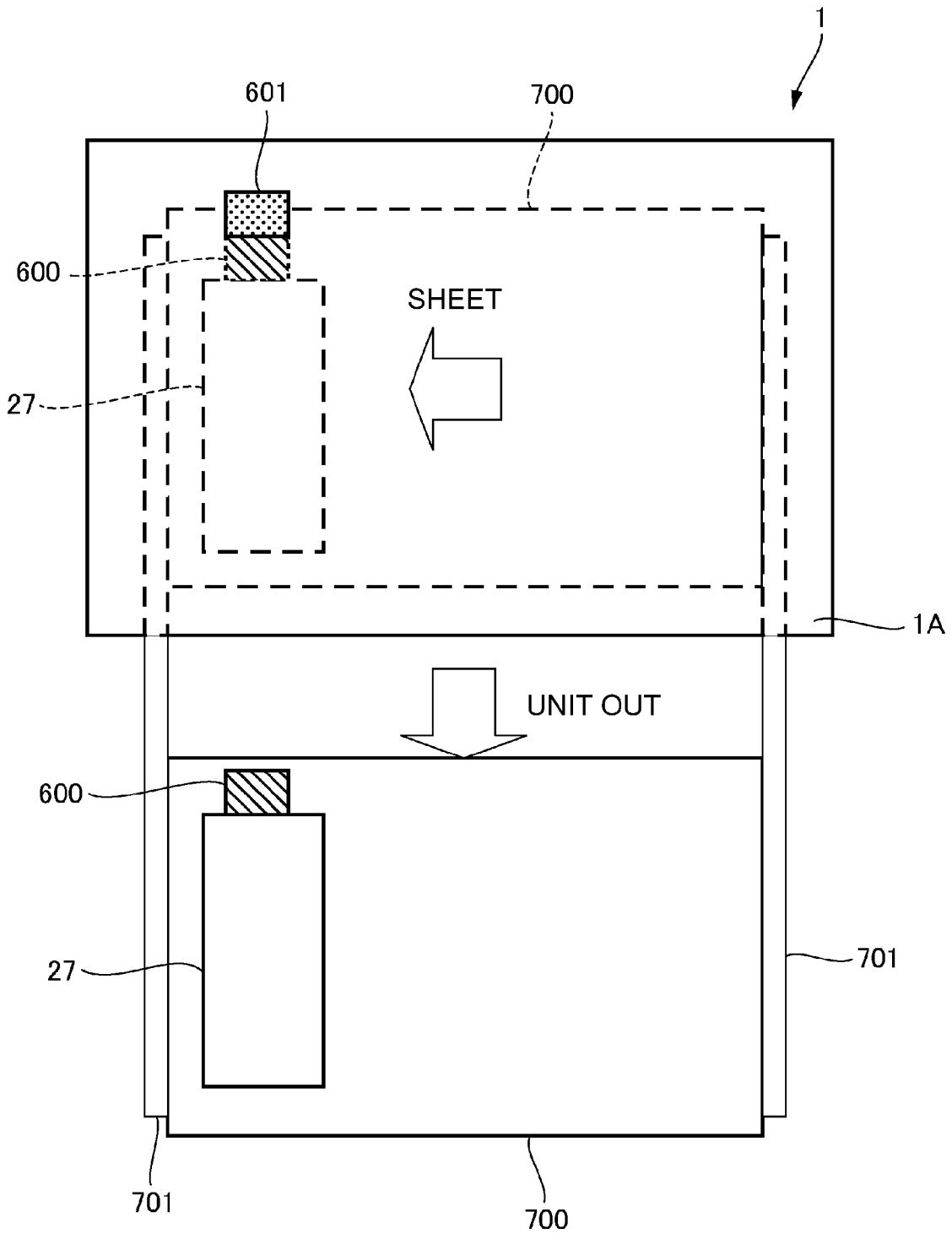
FIG. 9 is a schematic view illustrating a drawing structure of a fixing feed unit including the fixing device.

In this embodiment, a home position (HP position) is the position at which the sensor flag 440 just block the light of position sensor 450 by the movement of the heating unit 27A from a position not blocking the light of the position sensor 450. In position HP, a widthwise center portion of recording material entering the nip N and a widthwise center portion of the heat generation width of heating belt 302 (widthwise center portion of heating region) are substantially aligned with each other. Therefore, as shown in FIG. 9, when a maximum size recording material is passed through the nip N, the heating unit 27A is moved to the HP position, by which the center portion of the heat generation width and the center portion of the recording material of the maximum size can be aligned with each other.

In this embodiment, the relation between the sensor flag 440 and the position sensor 450 is set in such a manner, and therefore, the heat generation width of the heating belt 302 can be reduced. That is, when the center portion of the maximum size recording material and the center portion of the heat generation width are deviated from each other, it is necessary to make the heat generation width larger than the heating region of the maximum size recording material by the amount of the deviation in order to cover the maximum size recording material. On the contrary, by aligning the center portion of the maximum size recording material with the center portion of the heat generation width, the heat generation width may be the same as the heating region for the maximum size recording material, and therefore, the necessity for making the heat generation width large.

In this manner, in this embodiment, the reciprocating shaft 410 is engaged with the groove 430*d* formed in the reciprocating cam 430, and the reciprocating cam 430 is rotated so that the reciprocation moving operation of heating unit 27A is effected. It is unnecessary to employ an urging means such a spring as disclosed in Japanese Laid-open Patent Application 2005-351939 to urge the cam 430 to the cam surface, and therefore, the required torque can be reduced. By this, the driving structure can be downsized, and therefore, the space required by the reciprocating mechanism can be reduced.

Such a reciprocation control (reciprocation moving operation) is carried out for each recording material. That is, the controller 460 moves the heating unit 27A through a predetermined amount for each passage of the recording material through the nip N. In this embodiment, the heating unit 27A is moved during the recording material passing through the nip N after the trailing edge of recording material depart the secondary transfer portion. The movement distance is preferably approx. 0.1-0.2 mm per sheet.

The frequency of the reciprocation moving operations may be one for each sheet, of one for every 2, 3 or another plural sheets. The heating unit 27A is moved at every predetermined number of sheets passing the nip N. The predetermined number of sheets may be constant, or may be variable depending on the kind, the size of recording material, the number of the processed sheets or the like.

In this embodiment, the inclination angle of inclined surfaces 430*a*, 430*b* of cam 430 are selected such that the movement distance per one recording martial is 0.15 mm in the range other than the moving direction switching range. The range of reciprocation control (reciprocation moving operation) is approx. 4-5 mm, for example. In other words, the heating unit 27A movement by increment of 0.15 mm within the movement range of approx. 4-5 mm.

The timing of the execution of the reciprocation moving operation is in the period in which no recording material is in the nip N, that is, so-called sheet interval, but in this embodiment, the timing is selected as described above. More particularly, it is after the trailing edge of recording material departs the secondary transfer portion, before the leading end reaches the nip N and during the period in which the recording material is nipped only by the nip N. This is because by the reciprocation control (reciprocation moving operation) during a sheet interval may result in the reduction of the productivity, because the sheet interval period may have to be expanded. In addition, if the heating unit 27A carries out the reciprocating operation while the recording material is nipped by the secondary transfer portion and the nip N of the heating unit 27A, the nip N deviates the recording material in the widthwise direction with the result of transfer defect. Therefore, in this embodiment, the timing of the execution of the reciprocating operation is selected as described above.

[Drawing Structure for Fixing Feed Unit]

As shown in FIG. 9, in this embodiment, the fixing feed unit (drawing mechanism) 700 including the fixing device 27 is drawable from the main assembly 1A of the image forming apparatus. The main assembly 1A accommodates the above-described image forming stations PY, PM, PC, PK, the intermediary transfer belt 25, various recording material feeding structures and the fixing device 27. The fixing feed unit 700 includes a part of the structure for feeding the recording material from the secondary transfer portion to the fixing device 27, such as an outside secondary transfer roller disposed outside the intermediary transfer belt 25 of the secondary transfer device 26 (FIG. 1) and outside the fixing device 27.

The main assembly 1A is provided with a slide rail 701 as a guiding member along a drawing direction of the fixing feed unit 700. The fixing feed unit 700 is carried on the slide rail 701 so that the fixing feed unit 700 is movable along the slide rail 701. The fixing feed unit 700 supports the fixing device 27 and a feeding structure for feeding the recording material to the fixing device 27 on a supporting plate, and the supporting plate is movably supported on the slide rail 701. The reciprocation base plate 403 of the fixing device 27 is fixed on the supporting plate, and therefore, is movably supported by main assembly 1A through the supporting plate. The reciprocation base plate 403 per se may be used as the supporting plate. That is, the reciprocation base plate 403 is made large to support the above-described feeding structures in addition to the heating unit 27A on the reciprocation base plate 403.

With such structures, the fixing feed unit 700 can be drawn out by opening the door in the front side or lateral side of the main assembly 1A, so that a jammed sheet in the fixing device 27 or in the feeding structure can be taken out.

In the case of this embodiment, when the fixing feed unit 700 is drawn out, a heating side connector 600 provided in the fixing device 27 is separated from the main assembly side connector (device connector) 601 provided in the main assembly 1A, so that they are electrically disconnected. The heating side connector (electric energy supply connector, communication connector) 600 and the main assembly side connector 601 have drawer connector structures, and they are connected to each other when the fixing feed unit 700 is inserted into the main assembly 1A, and are separated from each other when the fixing feed unit 700 is drawn out from the main assembly side. On the other hand, when the fixing feed unit 700 is pushed into the main assembly 1A to set the fixing feed unit 700 in the main assembly 1A, the heating side connector 600 is connected to the main assembly side connector 601.

[Connection Structure of Connectors]

Figure 10:
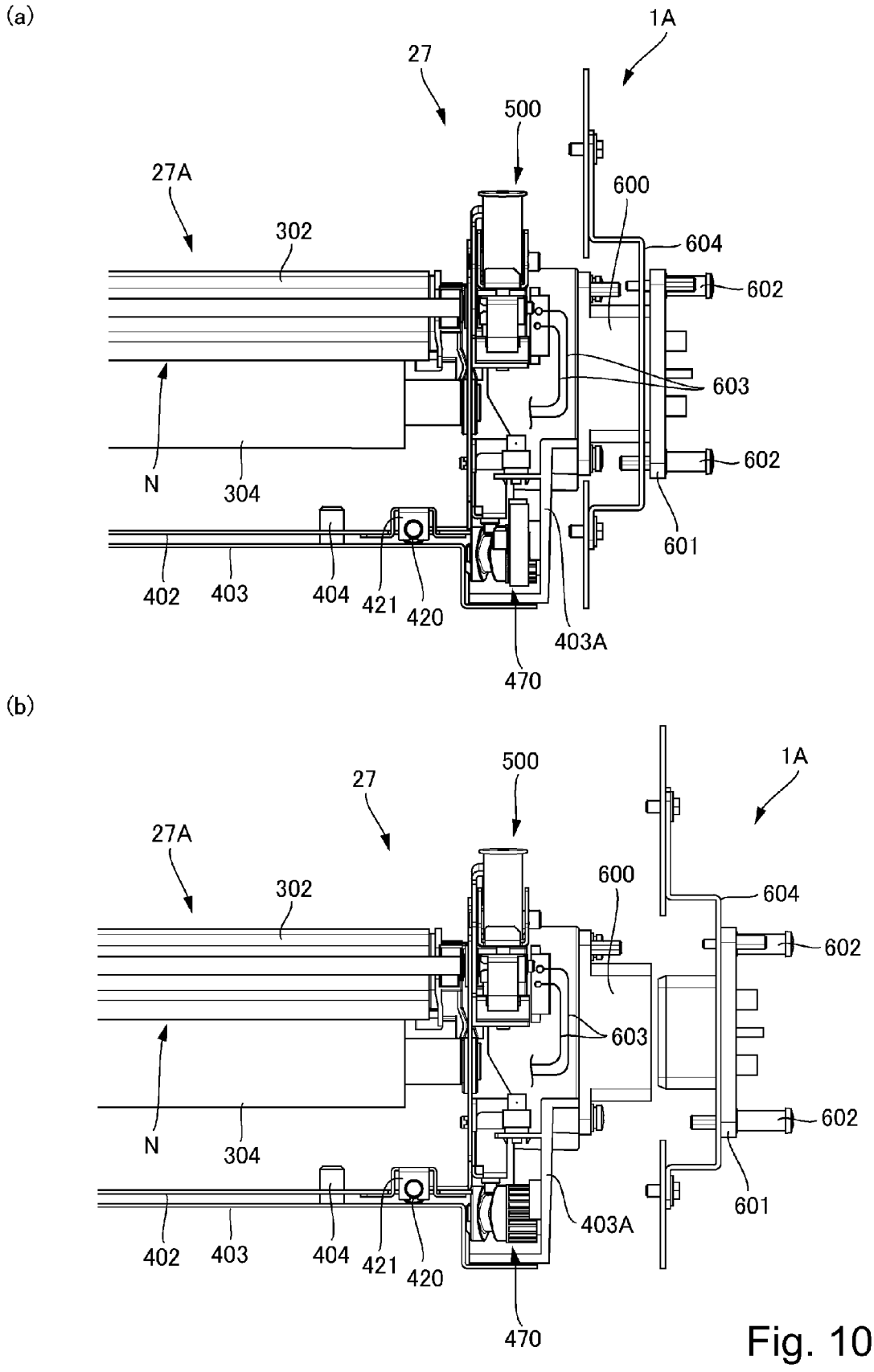
FIG. 10 is enlarged views of the connecting portion between a heating side connector of the fixing device and a main assembly side of the apparatus connector provided in the main assembly of the image forming apparatus, in a connected state (a) of the connectors and in a separated state (b) of them.

Referring to FIG. 10, the structure of the connecting portion between the heating side connector 600 and the main assembly side connector 601 will be described. The heating side connector 600 is connected with the main assembly 1A by a plurality of electric wires (electric energy supply lines, communication lines) 603 to effect at least one of electric power supply from the main assembly 1A to the heating unit 27A and signal communication between the heating unit 27A and the main assembly 1A. The electric wires 603 are flexible to a certain extent, the heating side connector 600 is movable relative to the heating unit 27A.

The electric wires 603 include those for the thermister 307 for detecting the temperature of the heating belt 302, those for the position sensors 450 and those for supplying the electrical power to the heater 300. The electric wires 603 are concentrated in a rear side of the main assembly 1A, that is, the trailing end portion with respect to the drawing direction of the fixing feed unit 700, and the heating side connector 600 is provided at the free end portion. Therefore, the heating side connector 600 is also disposed in the rear side of the main assembly 1A.

In addition, in the rear side of the main assembly 1A, the main assembly side connector 601 is disposed at a position opposing the heating side connector 600 along the guiding direction (the moving direction of the fixing feed unit 700) of the slide rail 701. The main assembly side connector 601 is connectable with and disconnectable from the heating side connector 600 by the movement of the fixing device 27 together with the fixing feed unit 700. In the illustrated example, the heating side connector 600 is a female connector, and the main assembly side of the apparatus connector 601 is a male connector, wherein the connector 601 enters the heating side connector 600, so that the connection is established as shown in part (a) of FIG. 10. On the other hand, by drawing the fixing feed unit 700 out, the heating side connector 600 is separated from the connector 601, as shown in part (b) of FIG. 10.

The main assembly side connector 601 is supported by a fixed plate portion 604 as a fixed portion fixed to the rear side of main assembly 1A movably in the moving direction of the fixing feed unit 700. Between the main assembly side connector 601 and the fixed plate portion 604, there is provided a connector spring 602 as an urging mechanism for urging the main assembly side connector 601 toward the heating side connector 600.

Therefore, as shown in part (a) of FIG. 10, by the spring 602, the main assembly side connector 601 urges the heating side connector 600 at an predetermined pressure in the state that the heating side connector 600 is connected with the main assembly side connector 601. For example, a spring pressure of the connector spring 602 is approx. 1.6 kgf (15.7N) per one. In the illustrated example, two connector springs 602 are provided interposing the main assembly side connector 601, and the total pressure is approx. 3.2 kgf (31.4N). By the main assembly side connector 601 urging the heating side connector 600 at the predetermined pressure, the connection between the connectors is assured.

By the connection between the heating side connector 600 and the main assembly side connector 601 as described above, the electrical connections are established to enable electric power supply and the transmission of the signal indicative of the state of fixing device 27 to the CPU of the main assembly 1A. More particularly, the electric power is supplied from the main assembly 1A to the fixing feed unit 700 through the heating side connector 600 and the main assembly side connector 601, and various signals are exchanged between the main assembly 1A and the fixing feed unit 700.

In this embodiment, the heating side connector 600 is fixed on the reciprocation base plate 403. Therefore, a connector supporting portion (drawer tray) 403A is fixed in the rear side of the main assembly 1A of the reciprocation base plate 403. The connector supporting portion 403A may be integral with the reciprocation base plate 403. The heating side connector 600 is fixed to the connector supporting portion 403A.

Therefore, the heating side connector 600 do not move together with the heating unit 27A even if the heating unit 27A reciprocates as described above. In addition, the heating side connector 600 and the heating unit 27A are connected by the electric wires 603 as described above, and therefore, the movement of the heating unit 27A is permitted relative to the heating side connector 600 in the reciprocating operation.

In this embodiment, as described above, the heating unit 27A is moved (a part of reciprocating operation) each passages of predetermined number of the recording material through the nip. Therefore, lateral edges of the recording materials do not pass the same portions of the nip N, and the surface of the heating belt 302 is protected from the edge flaw.

In addition, in this embodiment, the relative movement is caused between the reciprocating cam 430 and the reciprocating shaft 410 to move the heating unit 27A by the engagement between the reciprocating shaft 410 and the pair of inclined surfaces 430*a*, 430*b* of the reciprocating cam 430 to effect the reciprocation movement in a long term. Therefore, no spring or the like is required in order to move the heating unit 27A. Therefore, the motor is not required to drive the cam against an urging force of the spring, and the torque required for the rotation of the cam 430 may be relatively small, thus accomplishing the reciprocating mechanism with the small space.

The heating side connector 600 is not fixed to a reciprocating heating unit 27A, but is fixed to the connector supporting portion 403A of the reciprocation base plate (supporting mechanism) 403 supported movably relative to the main assembly 1A of the image forming apparatus. Therefore, the load applied to the connecting portion between the heating side connector 600 and the main assembly side connector 601 by the reciprocation movement of the heating unit 27A. More particularly, even in the reciprocating operation of the heating unit 27A the heating side connector 600 does not move, and therefore, the load applied to the connecting portion between the heating side connector 600 and the main assembly side connector 601 can be reduced. As a result, the connection between the heating side connector 600 and the main assembly side connector 601 can be assured despite the reciprocation movement of the heating unit 27A.

In addition, the heating side connector 600 is urged by the connector spring 602 through the main assembly side connector 601, but the heating side connector 600 is fixed to the reciprocation base plate 403, and therefore, the urging force is not applied to the heating unit 27A. In addition, the urging force is not applied to the heating unit 27A, and therefore, weight reduction and downsizing of the heating unit 27A can be accomplished.

For example, in the case that the heating side connector 600 is mounted directly to the heating unit 27A, it may be mounted to the rear side plate 401 supporting the heating belt 302 and the pressing roller 304. In such a case, the side plate 401 may be deformed by the urging force of the connector spring 602 urging the heating side connector 600, with the result of influence to the pressure distribution in the nip between the heating belt 302 and the pressing roller 304. If the pressure distribution of the nip changes significantly, the recording material may be creased, or the feeding of the recording material may become improper.

The plate thickness of the side plate 401 may be increased to enhance the stiffness taking the urging force of connector spring 602 into consideration, but then the weight of the heating unit 27A increases. With the increase of the heating unit 27A, the output of the motor M2 for reciprocating the heating unit 27A has to be increased, with the result of upsizing of the fixing device 27.

According to this embodiment, however, the heating side connector 600 is fixed to the connector supporting portion 403A of the reciprocation base plate 403 not to the side plate 401 of the heating unit 27A, and therefore, the urging force of the connector spring 602 does not lead to the deformation of the side plate 401. For this reason, the influence of the urging force of the connector spring 602 to the nip pressure can be avoided. In addition, as described above, it is not necessary to enhance the stiffness of the side plate 401, and therefore, a light weight heating unit 27A can be accomplished. The weight reduction of the heating unit 27A permits selection of a small output motor M2 for the reciprocating operation of the heating unit 27A, so that the fixing device 27 can be downsized.

According to this embodiment, the electrical connection between the fixing device 27 and the main assembly 1A of the image forming apparatus is stabilized, and the nip pressure is stabilized, in the structure in which the heating unit 27A is reciprocated. In addition, the weights and sizes of the heating unit 27A and the fixing device 27 can be reduced.

According to this embodiment, as described in the foregoing, the edge flaw of heating belt 302 is reduced, and therefore, the image quality and the lifetime can be improved, without upsizing the device.

Other Embodiments

The present invention is not limited to the foregoing embodiment. In the above-described embodiment, the fixing device is an on-demand type fixing device using a film-like heating belt as the rotatable heating member. The rotatable heating member may be a roller or belt. The heating mechanism in the foregoing embodiment is a ceramic heater, but it may be a halogen heater, or an induction heating mechanism using an excitation coil (IH). Particularly in the case of the IH type, two AC wires are used, and therefore, the number of the drawer connectors increases with the result of increase of the spring pressure to the fixing device from the main assembly side connector. Therefore, the present invention is particularly effective to the fixing device of an IH type.

The positional relation between the sensor flag and the position sensor may be the opposite. More particularly, the position sensor may be provided on the reciprocation movement side, and the sensor flag is provided on the non-reciprocation side. The means for detecting the position of the heating unit with respect to the widthwise direction may be the combination of the sensor flag and the position sensor, or may use an encoder. For example, an encoder is provided on the rotation shaft of the motor, and the rotation amount of the encoder is counted, and the home position can be made detected, by which the position of the heating unit from the home position can be detected. It will suffice if the position of the heating unit with respect to the widthwise direction can be detected.

The reciprocating mechanism have used the cam and the shaft in the foregoing, but another structure is usable. For example, the inclination member may be a screw shaft having an outer peripheral surface male screw, and the engageable member may be a nut screwed on the screw shaft. It will suffice if the reciprocation movement can be carried out.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 195667/2012 filed Sep. 6, 2012, which is hereby incorporated by reference.

What is claimed is:

1. An image forming apparatus comprising:

(i) an image forming station configured to form a toner image on a sheet;

(ii) a fixing device configured and positioned to fix the toner image formed on the sheet by said image forming station at a fixing nip, said fixing device comprising:

(ii-i) a fixing unit including a pair of rotatable members configured to form the fixing nip therebetween, (ii-ii) a supporting mechanism configured and positioned to movably support said fixing unit, (ii-iii) a reciprocating mechanism configured and positioned to reciprocate said fixing unit relative to said supporting mechanism in a longitudinal direction of said fixing unit, (ii-iv) an electric energy supply connector provided on said supporting mechanism and configured and positioned to supply electric energy to said fixing unit, and (ii-v) an electric energy supply wire connecting between said electric energy supply connector and said fixing unit and having enough length to permit reciprocation of said fixing unit by said reciprocating mechanism;

(iii) a drawing mechanism configured to permit drawing said fixing device out of said image forming apparatus while supporting said fixing device;

(iv) an apparatus connector connectable to said electric energy supply connector by insertion of said drawing mechanism into said image forming apparatus; and (v) a spring configured and positioned to urge said apparatus connector toward said electric energy supply connector along a direction substantially parallel to an inserting direction of said drawing mechanism, in a state that said electric energy supply connector is connected to said apparatus connector by the insertion of said drawing mechanism.

2. An apparatus according to claim 1, wherein said reciprocating mechanism includes (i) a rotatable cam provided on said supporting mechanism and (ii) a cam follower provided on said fixing unit and engageable with said rotatable cam.

3. An apparatus according to claim 1, wherein said reciprocating mechanism moves said fixing unit in the longitudinal direction for each passage of a predetermined number of the sheets.

4. An apparatus according to claim 1, wherein said fixing unit includes a heating mechanism, and one of said rotatable members is an endless belt for being heated by said heating mechanism.

5. An image forming apparatus comprising:

(i) an image forming station configured to form a toner image on a sheet;

(ii) a fixing device configured and positioned to fix the toner image formed on the sheet by said image forming station at a fixing nip, said fixing device comprising:

(ii-i) a fixing unit including a pair of rotatable members configured to form the fixing nip therebetween, (ii-ii) a supporting mechanism configured and positioned to movably support said fixing unit, (ii-iii) a reciprocating mechanism configured and positioned to reciprocate said fixing unit relative to said supporting mechanism in a longitudinal direction of said fixing unit, (ii-iv) a communication connector provided on said supporting mechanism and configured and positioned to communicate with said fixing unit, and (ii-v) a communication wire connecting between said communication connector and said fixing unit and having enough length to permit reciprocation of said fixing unit by said reciprocating mechanism;

(iii) a drawing mechanism configured to permit drawing said fixing device out of said image forming apparatus while supporting said fixing device;

(iv) an apparatus connector connectable to said communication connector by insertion of said drawing mechanism into said image forming apparatus; and (v) a spring configured and positioned to urge said apparatus connector toward said communication connector along a direction substantially parallel to an inserting direction of said drawing mechanism, in a state that said communication connector is connected to said apparatus connector by the insertion of said drawing mechanism.

6. An apparatus according to claim 5, wherein said reciprocating mechanism includes (i) a rotatable cam provided on said supporting mechanism and (ii) a cam follower provided on said fixing unit and engageable with said rotatable cam.

7. An apparatus according to claim 5, wherein said reciprocating mechanism moves said fixing unit in the longitudinal direction for each passage of a predetermined number of the sheets.

8. An apparatus according to claim 5, wherein said fixing unit includes a heating mechanism, and one of said rotatable members is an endless belt for being heated by said heating mechanism.

* * * * *